US007658527B2

(12) United States Patent
Gwatkin, III

(10) Patent No.: US 7,658,527 B2
(45) Date of Patent: Feb. 9, 2010

(54) SYSTEMS AND METHODS FOR ADJUSTING LIGHT OUTPUT OF SOLID STATE LIGHTING PANELS, AND ADJUSTABLE SOLID STATE LIGHTING PANELS

(75) Inventor: James deGoulard Gwatkin, III, Greensboro, NC (US)

(73) Assignee: Cree, Inc., Durham, NC (US)

( * ) Notice: Subject to any disclaimer, the term of this patent is extended or adjusted under 35 U.S.C. 154(b) by 732 days.

(21) Appl. No.: 11/353,583

(22) Filed: Feb. 14, 2006

(65) Prior Publication Data

US 2007/0188484 A1 Aug. 16, 2007

(51) Int. Cl.
*F21V 7/04* (2006.01)

(52) U.S. Cl. ..... 362/555; 362/295

(58) Field of Classification Search ..... 362/295, 362/555, 612

See application file for complete search history.

(56) References Cited

U.S. PATENT DOCUMENTS

| | | | | |
|---|---|---|---|---|
| 6,217,188 | B1 * | 4/2001 | Wainwright et al. | 362/555 |
| 6,234,645 | B1 * | 5/2001 | Borner et al. | 362/555 |
| 6,988,813 | B2 * | 1/2006 | Hoelen et al. | 362/555 |
| 7,083,302 | B2 * | 8/2006 | Chen et al. | 362/612 |
| 7,106,378 | B2 * | 9/2006 | Kawakami | 348/371 |
| 7,108,413 | B2 * | 9/2006 | Kwong et al. | 362/295 |
| 7,365,991 | B2 * | 4/2008 | Aldrich et al. | 362/612 |
| 7,372,499 | B2 * | 5/2008 | Kawakami | 362/612 |
| 7,481,554 | B2 * | 1/2009 | Anderson et al. | 362/183 |
| 2002/0025157 | A1 * | 2/2002 | Kawakami | 396/155 |
| 2006/0164830 | A1 * | 7/2006 | Justel | 362/295 |
| 2006/0176692 | A1 * | 8/2006 | Lee et al. | 362/295 |

OTHER PUBLICATIONS

Brochure, *Tomorrow's adjustable resistor: The Rejustor™ with eTC.* Copyright © Microbridge Technologies 2005.

Website, www.koaproducts.com/english/catalogue/046-047-RK73N.htm. Surface Mount Resistors, Trimmable Flat Chip Resistors [RK73N], Copyright (C) 2003-2005 KOA, accessed Nov. 10, 2005.

* cited by examiner

*Primary Examiner*—David V Bruce
(74) *Attorney, Agent, or Firm*—Myers Bigel Sibley & Sajovec

(57) ABSTRACT

A lighting panel includes a first circuit including a first LED configured to emit light at a first wavelength, a second circuit including a second LED configured to emit light at a second wavelength, and an adjustment circuit connected in parallel with the first circuit and configured to adjust a current through the first circuit. The adjustment circuit may include a trimmable resistor connected in parallel with the first circuit. Methods of manufacturing a lighting panel include mounting a plurality of lamps on a frame, each lamp including a first LED configured to emit light at a first wavelength and a second LED configured to emit light at a second wavelength, connecting selected ones of the first LEDs in a first circuit and selected ones of the second LEDs in a second circuit. An adjustment circuit, which may include a trimmable resistor, is connected in parallel with the first circuit, and a resistance of the adjustment circuit is adjusted to adjust a chromaticity of light emitted by the plurality of lamps when the plurality of lamps are energized.

31 Claims, 5 Drawing Sheets

SYSTEMS AND METHODS FOR ADJUSTING LIGHT OUTPUT OF SOLID STATE LIGHTING PANELS, AND ADJUSTABLE SOLID STATE LIGHTING PANELS

FIELD OF THE INVENTION

The present invention relates to solid state lighting, and more particularly to systems and methods for adjusting the chromaticity of solid state lighting panels, and adjustable solid state lighting panels.

BACKGROUND

Solid state lighting arrays are used for a number of lighting applications. For example, solid state lighting panels including arrays of solid state lamps have been used as direct illumination sources, for example, in architectural and/or accent lighting. A solid state lamp may include, for example, a packaged light emitting device including one or more light emitting diodes (LEDs). Inorganic LEDs typically include semiconductor layers forming p-n junctions. Organic LEDs (OLEDs), which include organic light emission layers, are another type of solid state light emitting device. Typically, a solid state light emitting device generates light through the recombination of electronic carriers, i.e. electrons and holes, in a light emitting layer or region.

Solid state lighting panels are commonly used as backlights for small LCD display screens, such as LCD display screens used in portable electronic devices. In addition, there has been increased interest in the use of solid state lighting arrays for backlights of larger displays, such as LCD television displays.

For smaller LCD screens, backlight assemblies typically employ white LED lamps that include a blue-emitting LED coated with a wavelength conversion phosphor that converts some of the blue light emitted by the LED into yellow light. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

The color rendering index of a light source is an objective measure of the ability of the light generated by the source to accurately illuminate a broad range of colors. The color rendering index ranges from essentially zero for monochromatic sources to nearly 100 for incandescent sources. Light generated from a phosphor-based solid state light source may have a relatively low color rendering index.

For large-scale backlight and illumination applications, it is often desirable to provide a lighting source that generates a white light having a high color rendering index, so that objects and/or display screens illuminated by the lighting panel may appear more natural. Accordingly, such lighting sources may typically include an array of solid state lamps including red, green and blue light emitting devices. When red, green and blue light emitting devices are energized simultaneously, the resulting combined light may appear white, or nearly white, depending on the relative intensities of the red, green and blue sources. There are many different hues of light that may be considered "white." For example, some "white" light, such as light generated by sodium vapor lamps, may appear more yellowish, while other "white" light, such as light generated by some fluorescent lamps, may appear more bluish in color.

For larger display and/or illumination applications, multiple solid state lighting panels may be connected together, for example, in a two dimensional array, to form a larger lighting panel. Unfortunately, however, the hue of white light generated may vary from panel to panel, and/or even from lamp to lamp. Such variations may result from a number of factors, including variations of intensity of emission from different LEDs, and/or variations in placement of LEDs in a lamp. Accordingly, in order to construct a multi-panel display that produces a consistent hue of white light from panel to panel, it may be desirable to measure the hue and saturation, or chromaticity, of light generated by a large number of panels, and to select a subset of panels having a relatively close chromaticity for use in the multi-panel display. This may result in decreased yields and/or increased inventory costs for a manufacturing process.

SUMMARY

Some embodiments of the invention provide a lighting panel having a first circuit including at least a first light emitting device configured to emit light at a first wavelength, a second circuit including at least a second light emitting device configured to emit light at a second wavelength different from the first wavelength, and an adjustment circuit connected in parallel with the first circuit and configured to adjust a current through the first circuit. The adjustment circuit may include a trimmable resistor connected in parallel with the first circuit.

The lighting panel may further include a second trimmable resistor in parallel with the second string, and/or a third circuit including at least a third light emitting device configured to emit light at a third wavelength different from the first wavelength and the second wavelength.

Light emitted by the first light emitting device, the second light emitting device and the third light emitting device may combine to produce white or near-white light. Moreover, light emitted by the first light emitting device, the second light emitting device and the third light emitting device may combine to produce light having a chromaticity that may be perceptibly different than light that would be generated by the first light emitting device, the second light emitting device and the third light emitting device in the absence of the trimmable resistor.

In particular, light emitted by the first light emitting device, light emitted by the second light emitting device and light emitted by the third light emitting device may combine to produce light having first color coordinates in a perceptual chromaticity space that are spaced by at least a threshold distance away from second color coordinates in the perceptual chromaticity space of light that would be generated by the first light emitting device, the second light emitting device and the third light emitting device in the absence of the trimmable resistor.

The threshold distance may be at least equal to a distance on the perceptual chromaticity space required for an observer to perceive a difference in chromaticity between the first color coordinates and the second color coordinates. The perceptual chromaticity space may include a set of CIE-u'v' coordinates, and the threshold distance may be 0.005.

The first, second and third light emitting devices may be mounted in a single lamp in the lighting panel.

The first circuit may include a plurality of first light emitting devices connected in serial and configured to emit light at the first wavelength and the second circuit may include a plurality of second light emitting devices connected in serial and configured to emit light at the second wavelength.

The lighting panel may further include a plurality of lamps, and each lamp may include at least one of the plurality of first light emitting devices and at least one of the plurality of second light emitting devices.

Methods of manufacturing a lighting panel according to some embodiments of the invention include mounting a plurality of lamps on a panel, each lamp including at least a first light emitting device configured to emit light at a first wavelength and a second light emitting device configured to emit light at a second wavelength, connecting selected ones of the first light emitting devices of the plurality of lamps in a first circuit, and connecting selected ones of the second light emitting devices of the plurality of lamps in a second circuit.

An adjustment circuit is connected in parallel with the first circuit, and a resistance of the adjustment circuit is adjusted to thereby adjust a chromaticity of light emitted by the plurality of lamps when the plurality of lamps are energized. The adjustment circuit may include a trimmable resistor, and adjusting the resistance of the adjustment circuit may include trimming the trimmable resistor.

Some methods may further include energizing the selected ones of the first light emitting devices and the selected ones of the second light emitting devices, and detecting a chromaticity of light emitted by the selected ones of the first light emitting devices and the selected ones of the second light emitting devices.

The resistance of the trimmable resistor may be adjusted in response to the detected chromaticity of light.

Methods of manufacturing a lighting panel according to further embodiments of the invention include mounting on a panel a plurality of first light emitting devices configured to emit light at a first wavelength and a plurality of second light emitting devices configured to emit light at a second wavelength, connecting selected ones of the first light emitting devices in a first circuit, and connecting selected ones of the second light emitting devices in a second circuit. A trimmable resistor is connected in parallel with the first circuit, and the resistance of the trimmable resistor is adjusted to thereby adjust a chromaticity of light emitted by the plurality of lamps when the lamps are energized.

The methods may further include energizing the selected ones of the first light emitting devices and the selected ones of the second light emitting devices, and detecting a chromaticity of light emitted by the selected ones of the first light emitting devices and the selected ones of the second light emitting devices. The resistance of the trimmable resistor may be adjusted in response to the detected chromaticity of light.

Methods of manufacturing a lighting panel according to further embodiments of the invention include energizing a plurality of first light emitting devices configured to emit light at a first wavelength at a current level, detecting an intensity of light emitted by the plurality of first light emitting devices, energizing a plurality of second light emitting devices configured to emit light at a second wavelength different from the first wavelength at the current level, and detecting an intensity of light emitted by the plurality of second light emitting devices. A chromaticity point of light that would be produced by combining light from the plurality of first light emitting devices and the plurality of second light emitting devices is calculated and compared with a desired chromaticity point. Then, there is calculated a difference in a drive current through the plurality of first light emitting devices compared to a drive current through the plurality of second light emitting devices that would cause light generated by the plurality of first light emitting devices and the plurality of second light emitting devices, when combined, to generate light having a chromaticity point at least within a threshold distance from the desired chromaticity point. The resistance of a trimmable resistor is adjusted in response to the calculated current difference. The threshold distance may be at least equal to a distance on a perceptual chromaticity space required for an observer to perceive a difference in chromaticity between the first chromaticity point and the second chromaticity point. The perceptual chromaticity space may include a set of CIE-u'v' coordinates, and the threshold distance may be 0.005.

The methods may further include mounting the plurality of first light emitting devices on a frame, connecting the plurality of first light emitting devices in serial, and connecting the trimmable resistor in parallel with the plurality of first light emitting devices.

A system for manufacturing a lighting panel according to some embodiments of the invention includes a detector configured to detect a chromaticity of light emitted by a lighting panel, a laser configured to adjust a resistance of a laser-trimmable resistor on the lighting panel, and a controller coupled to the detector and the laser. The controller is configured to calculate, responsive to the detected chromaticity of light, a difference in drive current through a plurality of first light emitting devices in the lighting panel compared to a drive current through a plurality of second light emitting devices in the lighting panel that would cause light generated by the plurality of first light emitting devices and the plurality of second light emitting devices, when combined, to generate light having a chromaticity point at least within a threshold distance from a desired chromaticity point. The controller is further configured to control the laser to adjust the resistance of the laser-trimmable resistor to provide the calculated difference in drive current when the plurality of first light emitting devices and the plurality of second light emitting devices are energized with a drive current.

According to some further embodiments of the invention, a system for manufacturing a lighting panel having a plurality of light emitting devices connected in serial and including an adjustment circuit connected in parallel to the plurality of light emitting devices includes a detector configured to detect a chromaticity of light emitted by the plurality of light emitting devices, and a controller coupled to the detector and configured to adjust the resistance of the adjustment circuit in response to the detected chromaticity.

Some embodiments of the invention provide a system for manufacturing a lighting panel including a plurality of light emitting devices, the system including a detector configured to detect a chromaticity of light emitted by a plurality of first light emitting devices and a plurality of second light emitting devices, and a controller coupled to the detector. The controller is configured to calculate, responsive to the detected chromaticity of light, a difference in drive current through the plurality of first light emitting devices compared to a drive current through the plurality of second light emitting devices that would cause light generated by the plurality of first light emitting devices and the plurality of second light emitting devices, when combined, to generate light having a chromaticity point at least within a threshold distance from a desired chromaticity point. The system may further include a trimmer coupled to the controller and configured to adjust the resistance of a trimmable resistor in response to the calculated difference in drive current.

The system may further include an assembler configured to receive the plurality of first light emitting devices, the plurality of second light emitting devices and the trimmable resistor, and to mount the plurality of first light emitting devices, the plurality of second light emitting devices and the trimmable resistor on a panel.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS OF THE INVENTION

Figure 1:
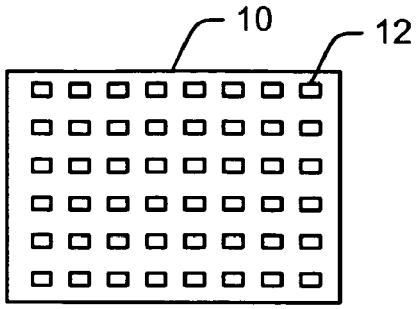
FIG. 1 is a front view of a solid state lighting panel.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to flowchart illustrations and/or block diagrams of methods, systems and computer program products according to embodiments of the invention. It will be understood that some blocks of the flowchart illustrations and/or block diagrams, and combinations of some blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

Figure 2:
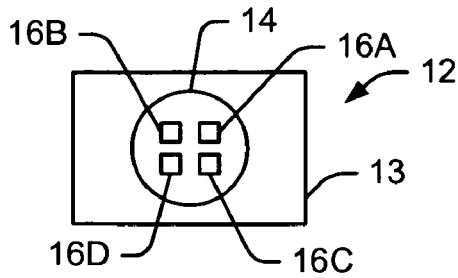
FIG. 2 is a top view of a packaged solid state lamp including a plurality of LEDs.

Referring now to FIG. 1, a solid state lighting panel 10 may include thereon a number of solid state lamps 12 arranged in a regular and/or irregular two dimensional array on a frame. The solid state lamps 12 may include, for example, organic and/or inorganic light emitting devices. An example of a solid state lamp 12 for high power illumination applications is illustrated in FIG. 2. The solid state lamp 12 includes a carrier substrate 13 on which a plurality of LEDs 16A-16D are mounted. The LEDs 16A-16D may include at least a red LED 16A, a green LED 16B and a blue LED 16C. Because green-emitting LEDs typically have a lower emission intensity compared to blue and/or red LEDs having similar dimensions, the lamp 12 may include an additional green LED 16D.

As further illustrated in FIG. 2, the LEDs 16A-16D may be covered by an encapsulant 14, which may be clear and/or may include light scattering particles, phosphors, and/or other elements to achieve a desired emission pattern, color and/or intensity. While not illustrated in FIG. 2, the lamp 12 may further include a reflector cup surrounding the LEDs 16A-16D, a lens mounted above the LEDs 16A-16D, one or more heat sinks for removing heat from the lamp, an electrostatic discharge protection chip, and/or other elements.

Figure 3:
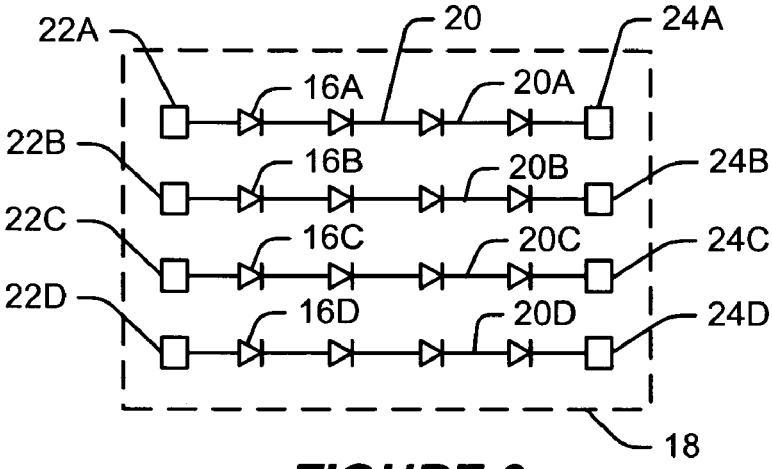
FIG. 3 is a schematic circuit diagram illustrating a conventional interconnection of LEDs in a solid state lighting panel.

LEDs 16A-16D in the panel 10 may be electrically interconnected as shown in the schematic circuit diagram in FIG. 3. As shown therein the LEDs may be interconnected such that multiple blue LEDs 16A are connected in serial in a circuit 20A. Likewise, the first green LEDs 16B may be arranged in serial in a circuit 20B, while the second green LEDs 16D may be arranged in serial in a separate circuit 20D. The red LEDs 16C may be arranged in serial in a circuit 20C. Each circuit 20A-20D may include an anode contact 22A-22D and a cathode contact 24A-24D. An circuit such as circuit 20A may include all, or less than all, of the corresponding LEDs on the panel 10. For example, the circuit 20A may include all of the blue LEDs from all of the lamps 12 on the panel 10. Alternatively, a circuit 20A may include only a subset of the corresponding LEDs on the panel 10, in which case LEDs of a particular color on the panel 10 may be interconnected in multiple circuits 20.

Figure 4:
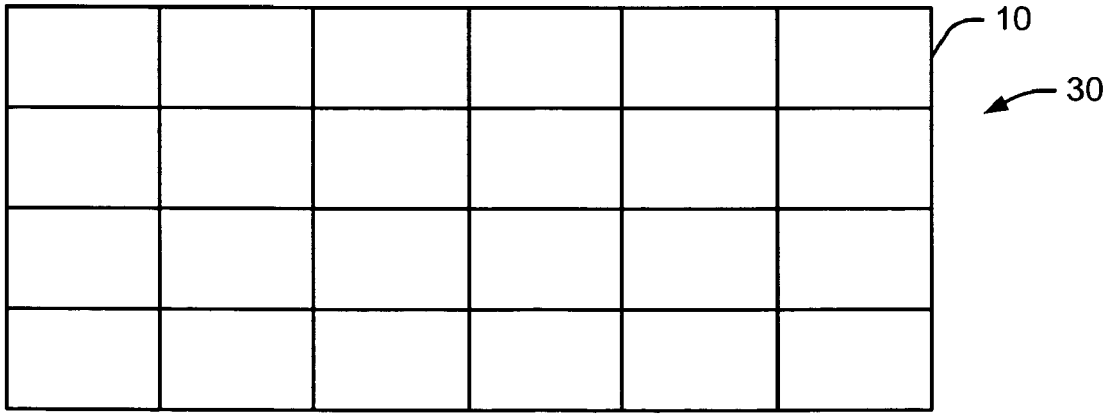
FIG. 4 is a front view of an assembly including multiple solid state lighting panels.

Multiple panels 10 may be assembled to form a larger lighting assembly 30 as illustrated in FIG. 4. While the assembly 30 shown in FIG. 4 is a two dimensional array of panels 10, other configurations are possible. For example, the panels 10 could be connected in a one-dimensional array, such as in a string of panels, or in a three dimensional configuration in which the panels 10 are not all arranged in the same plane.

Figure 5:
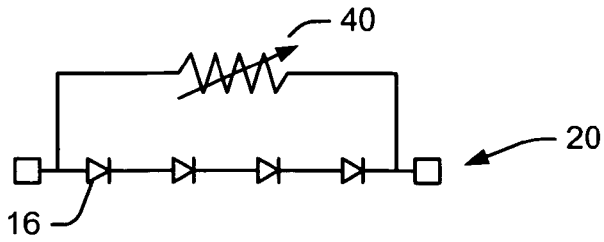
FIG. 5 is a schematic circuit diagram illustrating interconnection of LEDs in a solid state lighting panel according to some embodiments of the invention.

Referring now to the embodiments of FIG. 5, in order to adjust the chromaticity of light generated by a panel 10, a trimmable resistor 40 may be connected in parallel to the LEDs 16 in one or more of the circuits 20. The trimmable resistor 40 may include, for example, a laser-trimmable resistor such as a trimmable flat chip resistor model RK73N manufactured by KOA Products of Nagano, Japan. Other trimmable resistors, such as the KOA Products RK73N family may be used. The trimmable resistor 40 should be capable of providing a resistance that is adjustable at least within the range of about 2 kΩ to about 4 kΩ. The KOA Products RK73N family is specified to be trimmable over a suitable range of resistance values.

In some embodiments, the trimmable resistor may include an electronically re-adjustable resistor such as a Rejustor™ electronically re-adjustable resistor manufactured by Microbridge Technologies, Quebec, Canada. The resistance of an electronically re-adjustable resistor may be adjusted from time to time to account for changes in operating conditions and/or device performance. The term "trimmable resistor" is used herein to refer to any kind of adjustable resistor, including a laser-trimmable resistor and/or an electronically re-adjustable resistor.

By adjusting the resistance value of the trimmable resistor 40, the current passing through the LEDs 16 of the circuit 20 may be adjusted. Since the intensity of light emitted by LEDs 16 is related to the current passing through the devices, adjusting the resistance value of the trimmable resistor 40 has the effect of adjusting the intensity of light emitted by the LEDs 16 of the circuit 20. By adjusting the intensity of light emitted by a circuit 20 relative to the intensity of emission from the other circuits 20 in the display panel 10, the chromaticity of the combined light generated by the display panel may be adjusted. Accordingly, the chromaticity of light generated by a display panel 10, according to some embodiments of the invention, may be adjusted such that it is close to a desired chromaticity. For example, the chromaticity of light generated by a display panel 10 may be adjusted such that it is not readily distinguishable from a desired chromaticity.

An objective metric of the chromaticity of a light source is provided by the two dimensional CIE chromaticity diagrams. In a CIE chromaticity diagram, visible light having various chromaticity values (i.e. hue and saturation) is plotted on a two-dimensional graph. Thus, each possible hue and saturation is associated with an x- and y-coordinate (i.e. a chromaticity point) on a graph. Various hue/saturation combinations can be compared by looking at the relationship of their chromaticity points.

Figure 6:
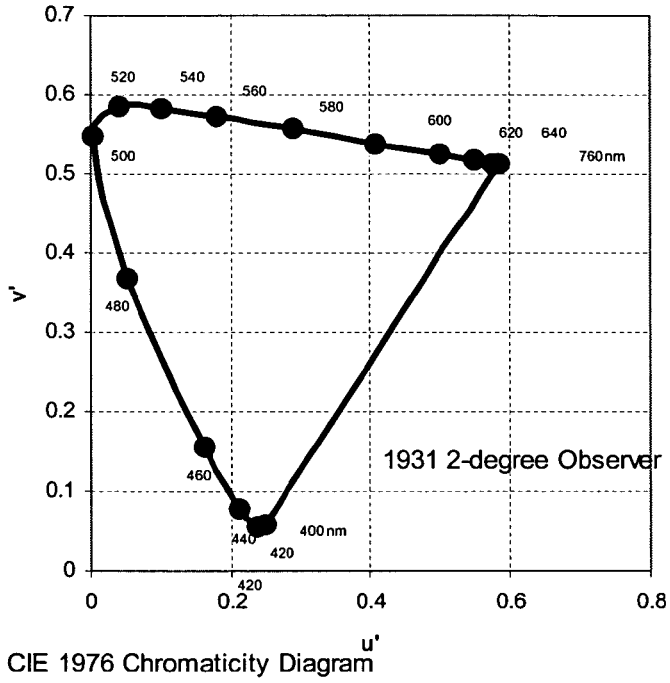
FIG. 6 is a graph of a CIE 1976 u'v' chromaticity diagram.

A CIE 1976 u'v' chromaticity diagram is illustrated in FIG. 6. In a CIE-u'v' chromaticity diagram, chromaticity values are plotted using scaled u- and v-parameters which take into account differences in human visual perception. That is, the human visual system is more responsive to certain wavelengths than others. For example, the human visual system is more responsive green light than red light. The CIE-u'v' chromaticity diagram is scaled such that the mathematical distance from one chromaticity point to another chromaticity point on the diagram is proportional to the difference in color perceived by a human observer between the two chromaticity points. A chromaticity diagram in which the mathematical distance from one chromaticity point to another chromaticity point on the diagram is proportional to the difference in color perceived by a human observer between the two chromaticity points may be referred to as a perceptual chromaticity space. In contrast, in a non-perceptual chromaticity diagram, two colors that are not distinguishably different may be located farther apart on the graph than two colors that are distinguishably different.

Figure 7:
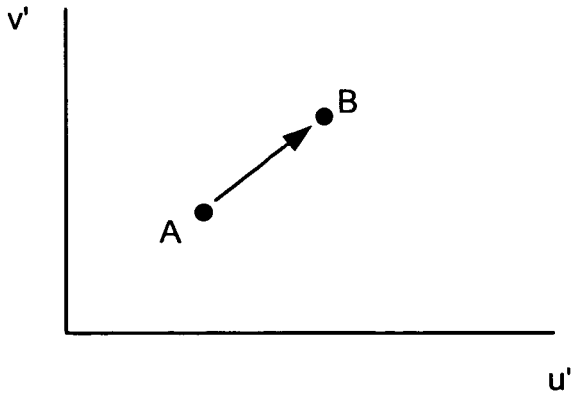
FIG. 7 is a graph showing two chromaticity points in a perceptual chromaticity space.

A lighting panel 10 may generate light having a first chromaticity point, such as chromaticity point A on the CIE-u'v' graph shown in FIG. 7. However, it may be desired for the light generated by the panel 10 to have a chromaticity at chromaticity point B. If the distance between the two chromaticity points A and B is greater than a threshold distance, the chromaticity of the light generated by the LED panel 10 may be adjusted by adjusting the resistance of the trimmable resistor 40 of one or more of the circuits 20 of the display panel 10. For example, if the chromaticity of the light generated by the display panel 10 is too blue, the resistance of a trimmable resistor 40 connected in parallel with a blue circuit 20A may be reduced, such that a relatively smaller amount of current passes through the blue LEDs 16A of the blue circuit 20A, resulting in relatively less intensity of blue light emitted by the display panel 10.

In some embodiments, the chromaticity point of a lighting panel may be adjusted if the measured chromaticity of the panel 10 is displaced by a threshold distance from a desired chromaticity point. For example, the threshold distance may be at least equal to a distance on a perceptual chromaticity space required for an observer to perceive a difference in chromaticity between the first color coordinates and the second color coordinates. In some embodiments, the threshold distance may be 0.005 units on a CIE 1976 u'v' chromaticity chart.

Many different configurations and adjustments are possible depending on the number and placement of trimmable resistors 40 and/or the number and arrangement of circuits 20 on the panel. For example, in some embodiments of the invention, a trimmable resistor 40 may be connected in parallel with only one circuit 20 of a plurality of circuits in a panel 10. Thus, only the current through one circuit may be adjusted. In other embodiments, more than one circuit may include a trimmable resistor 40 connected in parallel with the circuit. Thus, the current in more than one circuit may be adjusted by adjusting the resistance of one or more trimmable resistors.

In some embodiments, same-color LEDs may be connected in different circuits. For example, as illustrated in FIG. 3, there may be multiple circuits 20B, 20D of green LEDs. In that case, one, both or neither of the green circuits 20B, 20D may include a trimmable resistor 40 connected in parallel, and, accordingly, the intensity of one, both or neither of the circuits 20B, 20D may be adjusted.

It will be appreciated that the circuit interconnections illustrated in FIGS. 3 and 5 are schematic only, and that LEDs that are electrically connected need not be located in physical proximity on the panel. Accordingly, where multiple circuits of same-color LEDs are provided, it may be desirable for the LEDs in each circuit to be physically distributed uniformly over the area of the panel 10, so that when the current through a circuit is adjusted, the changed intensity is distributed over the entire area of the panel 10, instead of being concentrated in only a portion of the area of the panel 10.

Figure 8:
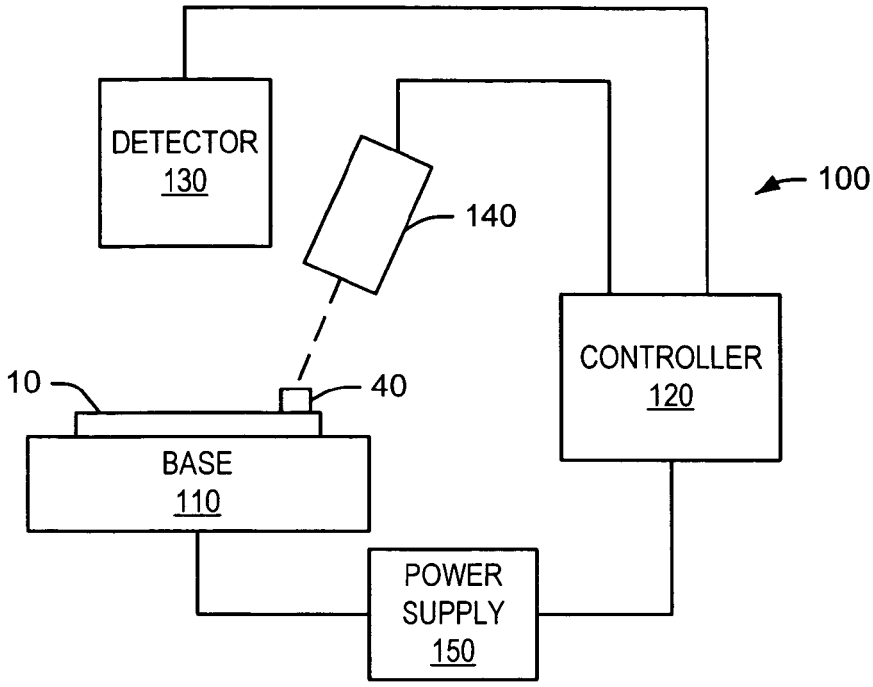
FIGS. 8 and 9 are block diagrams illustrating systems according to some embodiments of the invention.
Figure 9:
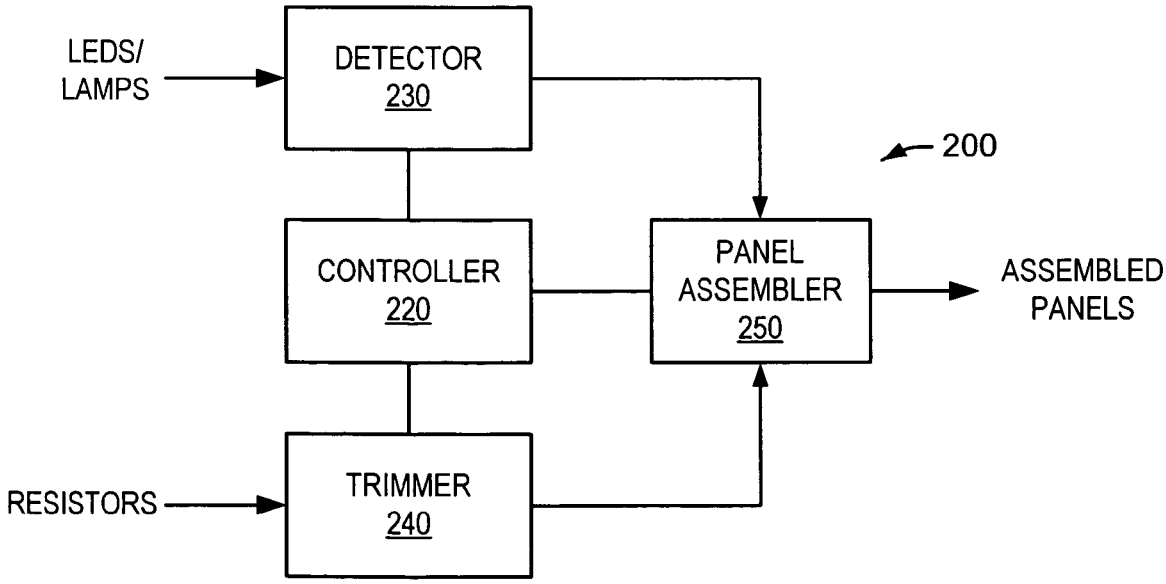

Systems for adjusting the intensity of light emitted by a lighting panel according to some embodiments of the invention are illustrated in FIGS. 8 and 9. Referring to the embodiments of FIG. 8, a system 100 includes a detector 130 configured to detect a chromaticity point of light generated by a lighting panel 10. The detector 130 may include, for example, an optical spectrometer. The light output being measured is delivered to the spectrometer either by a camera and lens, or through a fiber optic cable. As illustrated in FIG. 8, the lighting panel 10 may be provided on a base 110 that holds the panel 10 in place while it is being adjusted. A power supply 150 provides power to energize the lighting panel 10 during the test.

Chromaticity information detected by the detector 130 is provided to a controller 120. The controller 120 compares the measured chromaticity point provided by the detector 130 with a desired chromaticity point. If the measured chromaticity point of the panel 10 is displaced from a desired chromaticity point by a threshold distance, the controller determines an adjustment to one or more trimmable resistors 40 on the panel 10 that will cause the panel 10 to emit light at or near the desired chromaticity point.

In some embodiments, the controller 120 may control a laser 140, causing the laser 140 to trim a trimmable resistor 40 to an appropriate resistance. In other embodiments, the trimmable resistor 40 may include an electronically adjustable resistor, and the controller may electronically adjust a resistance of the resistor 40. Trimming/adjustment of electronically adjustable and/or laser-trimmable resistors is known in the art and need not be described in more detail herein.

In some embodiments, the process may be iterative. That is, the system 100 may determine a chromaticity point of the lighting panel 10 using the detector 130. The system 100 may adjust the resistance of one or more trimmable resistors 40 on the panel 10. After adjustment of the resistor(s) 40, the detector 130 may then detect the adjusted chromaticity point of the light generated by the panel 10. If the adjusted chromaticity point is still outside of a desired range, the system 100 may again adjust the resistance of one or more trimmable resistors 40 on the panel. The process may be repeated until a desired chromaticity point is obtained.

Systems 200 according to further embodiments of the invention are illustrated in FIG. 9. As illustrated in FIG. 9, systems 200 include a detector 230, a controller 220, a trimmer 240 and a panel assembler 250. Operations of the detector 230, the trimmer 240 and the panel assembler 250 are controlled by the controller 220. In the embodiments of FIG. 9, the chromaticity points of individual LEDs and/or lamps are measured before the panel is assembled. Such a configuration may enable manufacturing processes that are more streamlined and/or more efficient.

According to some embodiments of the invention, the emission intensities of a plurality of LEDs and/or solid state lamps that are to be assembled in a lighting panel are measured by the detector 230, and the measurements are provided by the detector 230 to the controller 220. The controller 220 estimates the chromaticity point of a display that would be generated from the plurality of LEDs based on the measured intensity values. Based on the estimated chromaticity point, the controller 220 determines a resistance value, or set of resistance values, for resistors connected in parallel to one or more strings of interconnected LEDs that would result in the panel 10 having a desired chromaticity point.

After determining an appropriate set of resistance values, the controller 220 causes the trimmer 240, which receives trimmable resistors as an input, to adjust the resistances of a desired number of resistors by the calculated amount(s). The LEDs and/or lamps are then provided to an assembler 250 along with the resistors trimmed by the trimmer 240. The assembler 250, which may be an automated assembly tool, then assembles a panel 10 using the received chips/lamps and the trimmed resistors. Accordingly, in some embodiments of the invention, resistance values can be appropriately adjusted before a lighting panel is actually constructed.

Figure 10:
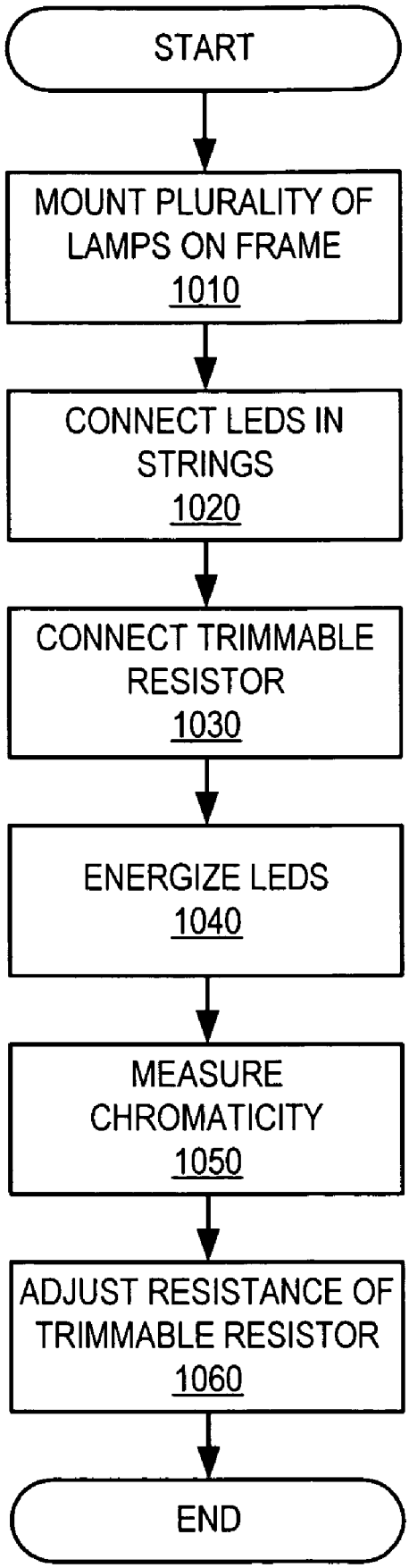
FIGS. 10 and 11 are flowchart diagrams illustrating operations according to some embodiments of the invention.

Operations according to some embodiments of the invention are illustrated in FIG. 10. As shown therein, such operations may include mounting a plurality of lamps on a frame (block 1010). Each lamp may include at least a first LED configured to emit light at a first wavelength and a second LED configured to emit light at a second wavelength. Selected ones of the first LEDs are connected in a first circuit, and selected ones of the second LEDs are connected in a second circuit (block 1020). A trimmable resistor is connected in parallel with the first circuit (block 1030). The selected ones of the first LEDs and the selected ones of the second LEDs are energized (block 1040), and a chromaticity of light emitted by the energized LEDs is measured (block 1050) In response to the chromaticity measurement, the resistance of the trimmable resistor is adjusted, to thereby adjust a chromaticity of light emitted by the plurality of lamps when the lamps are energized (block 1060). In particular, the resistance of the trimmable resistor may be adjusted in response to the detected chromaticity of light.

Figure 11:
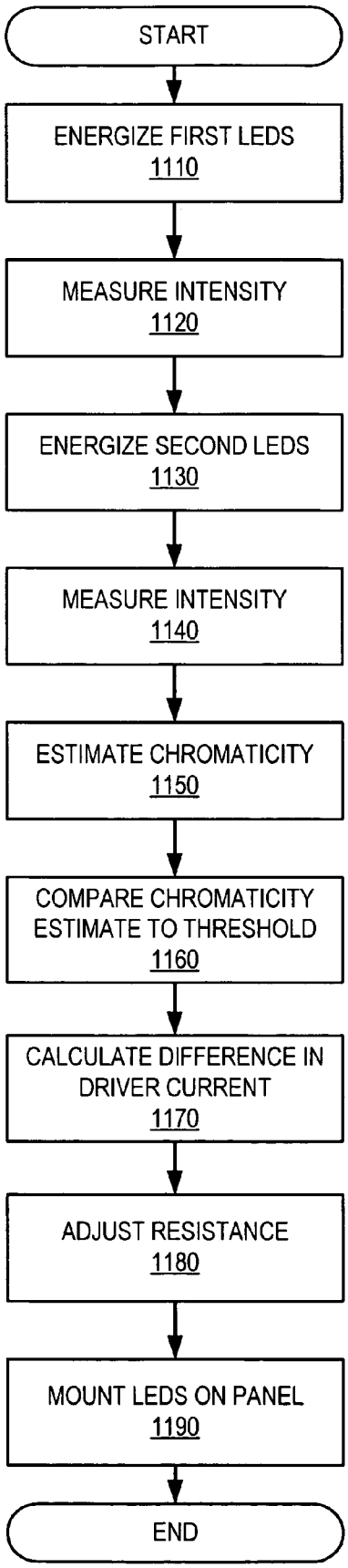

Operations according to further embodiments of the invention are illustrated in FIG. 11. As shown therein, such operations may include energizing a plurality of first LEDs configured to emit light at a first wavelength at a current level (block 1110), and detecting the intensity of light emitted by the plurality of first LEDs (block 1120). A plurality of second LEDs configured to emit light at a second wavelength different from the first wavelength are energized (block 1130), and the intensity of light emitted by the plurality of second LEDs is measured (block 1140).

A chromaticity point of light that would be produced by combining light from the plurality of first LEDs and the plurality of second LEDs is calculated (block 1150) and compared with a desired chromaticity point (block 1160). Next, there is calculated a difference in drive current through the plurality of first LEDs compared to a drive current through the plurality of second LEDs that would cause light generated by the plurality of first LEDs and the plurality of second LEDs, when combined, to generate light having a chromaticity point at least within a threshold distance from the desired chromaticity point (block 1170), and the resistance of a trimmable resistor is adjusted in response to the calculated current difference (block 1180). The plurality of first LEDs may be mounted on a panel in serial, and trimmable resistor may be connected in parallel with the plurality of first LEDs (block 1190).

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A lighting panel comprising:

a first circuit including at least a first light emitting device configured to emit light at a first wavelength;

a second circuit including at least a second light emitting device configured to emit light at a second wavelength different from the first wavelength; and an adjustment circuit connected in parallel with the first circuit and configured to adjust a current through the first circuit;

wherein the first circuit comprises an anode and a cathode and wherein the adjustment circuit is coupled between the anode and the cathode of the first circuit.

2. The lighting panel of claim 1, wherein the adjustment circuit comprises a trimmable resistor.

3. A lighting panel comprising:

a first circuit including at least a first light emitting device configured to emit light at a first wavelength;

a second circuit including at least a second light emitting device configured to emit light at a second wavelength different from the first wavelength; and an adjustment circuit connected in parallel with the first circuit and configured to adjust a current through the first circuit, wherein the adjustment circuit comprises a trimmable resistor, and further including a second trimmable resistor in parallel with the second string.

4. The lighting panel of claim 2, further including a third circuit including at least a third light emitting device configured to emit light at a third wavelength different from the first wavelength and the second wavelength.

5. The lighting panel of claim 4, wherein light emitted by the first light emitting device, light emitted by the second light emitting device and light emitted by the third light emitting device combine to produce white or near-white light.

6. The lighting panel of claim 4, wherein light emitted by the first light emitting device, light emitted by the second light emitting device and light emitted by the third light emitting device combine to produce light having a chromaticity that is perceptibly different than light that would be generated by the first light emitting device, the second light emitting device and the third light emitting device in the absence of the trimmable resistor.

7. The lighting panel of claim 5, wherein light emitted by the first light emitting device, light emitted by the second light emitting device and light emitted by the third light emitting device combine to produce light having first color coordinates in a perceptual chromaticity space that are spaced by at least a threshold distance away from second color coordinates in the perceptual chromaticity space of light that would be generated by the first light emitting device, the second light emitting device and the third light emitting device in the absence of the trimmable resistor.

8. The lighting panel of claim 7, wherein the threshold distance is at least equal to a distance on the perceptual chromaticity space required for an observer to perceive a difference in chromaticity between the first color coordinates and the second color coordinates.

9. The lighting panel of claim 7, wherein the perceptual chromaticity space comprises a set of CIE 1976 u'v' coordinates.

10. The backlight of claim 7, wherein the threshold distance is 0.005.

11. The lighting panel of claim 4, wherein the first light emitting device, the second light emitting device and the third light emitting device are mounted in a single lamp in the lighting panel.

12. The lighting panel of claim 1, wherein the first circuit comprises a plurality of first light emitting devices connected in serial and configured to emit light at the first wavelength and the second circuit comprises a plurality of second light emitting devices connected in serial and configured to emit light at the second wavelength.

13. The lighting panel of claim 12, further comprising a plurality of lamps, wherein each lamp includes at least one of the plurality of first light emitting devices and at least one of the plurality of second light emitting devices.

14. A method of manufacturing a lighting panel, comprising:

mounting a plurality of lamps on a frame, each lamp including at least a first light emitting device configured to emit light at a first wavelength and a second light emitting device configured to emit light at a second wavelength;

connecting selected ones of the first light emitting devices of the plurality of lamps in a first circuit, wherein the first circuit comprises an anode and a cathode;

connecting selected ones of the second light emitting devices of the plurality of lamps in a second circuit;

connecting an adjustment circuit in parallel with the first circuit, wherein connecting the adjustment circuit comprises connecting the adjustment circuit between the anode and the cathode of the first circuit; and adjusting a resistance of the adjustment circuit, to thereby adjust a chromaticity of light emitted by the plurality of lamps when the plurality of lamps are energized.

15. The method of claim 14, wherein the adjustment circuit comprises a trimmable resistor, and adjusting the resistance of the adjustment circuit comprises trimming the trimmable resistor.

16. A method of manufacturing a lighting panel, comprising:

mounting a plurality of lamps on a frame, each lamp including at least a first light emitting device configured to emit light at a first wavelength and a second light emitting device configured to emit light at a second wavelength;

connecting selected ones of the first light emitting devices of the plurality of lamps in a first circuit;

connecting selected ones of the second light emitting devices of the plurality of lamps in a second circuit;

connecting an adjustment circuit in parallel with the first circuit:

adjusting a resistance of the adjustment circuit, to thereby adjust a chromaticity of light emitted by the plurality of lamps when the plurality of lamps are energized, wherein the adjustment circuit comprises a trimmable resistor, and adjusting the resistance of the adjustment circuit comprises trimming the trimmable resistor;

energizing the selected ones of the first light emitting devices and the selected ones of the second light emitting devices; and detecting a chromaticity of light emitted by the selected ones of the first light emitting devices and the selected ones of the second light emitting devices.

17. The method of claim 16, wherein adjusting the resistance of the trimmable resistor is performed in response to the detected chromaticity of light.

18. A method of manufacturing a lighting panel, comprising:

mounting on a frame a plurality of first light emitting devices configured to emit light at a first wavelength and a plurality of second light emitting devices configured to emit light at a second wavelength;

connecting selected ones of the first light emitting devices in a first circuit, wherein the first circuit comprises an anode and a cathode;

connecting selected ones of the second light emitting devices in a second circuit;

connecting a trimmable resistor in parallel with the first circuit, wherein connecting the trimmable resistor comprises connecting the trimmable resistor between the anode and the cathode of the first circuit; and adjusting the resistance of the trimmable resistor, to thereby adjust a chromaticity of light emitted by the plurality of lamps when the lamps are energized.

19. A method of manufacturing a lighting panel, comprising:

mounting on a frame a plurality of first light emitting devices configured to emit light at a first wavelength and a plurality of second light emitting devices configured to emit light at a second wavelength;

connecting selected ones of the first light emitting devices in a first circuit;

connecting selected ones of the second light emitting devices in a second circuit;

connecting a trimrnable resistor in parallel with the first circuit;

adjusting the resistance of the trimmable resistor, to thereby adjust a chromaticity of light emitted by the plurality of lamps when the lamps are energized;

energizing the selected ones of the first light emitting devices and the selected ones of the second light emitting devices; and detecting a chromaticity of light emitted by the selected ones of the first light emitting devices and the selected ones of the second light emitting devices.

20. The method of claim 19, wherein adjusting the resistance of the trimmable resistor is performed in response to the detected chromaticity of light.

21. A method of manufacturing a lighting panel, comprising:

energizing a plurality of first light emitting devices configured to emit light at a first wavelength at a current level;

detecting an intensity of light emitted by the plurality of first light emitting devices;

energizing a plurality of second light emitting devices configured to emit light at a second wavelength different from the first wavelength at the current level;

detecting an intensity of light emitted by the plurality of second light emitting devices;

calculating a chromaticity point of light that would be produced by combining light from the plurality of first light emitting devices and the plurality of second light emitting devices;

comparing the calculated chromaticity point with a desired chromaticity point;

calculating a difference in a drive current through the plurality of first light emitting devices compared to a drive current through the plurality of second light emitting devices that would cause light generated by the plurality of first light emitting devices and the plurality of second light emitting devices, when combined, to generate light having a chromaticity point at least within a threshold distance from the desired chromaticity point; and adjusting a resistance of a trimmable resistor in response to the calculated current difference.

22. The method of claim 21, further comprising:

mounting the plurality of first light emitting devices on a frame;

connecting the plurality of first light emitting devices in serial; and connecting the trimmable resistor in parallel with the plurality of first light emitting devices.

23. The method of claim 21, wherein the threshold distance is at least equal to a distance on a perceptual chromaticity space required for an observer to perceive a difference in chromaticity between the first chromaticity point and the second chromaticity point.

24. The method of claim 23, wherein the perceptual chromaticity space comprises a set of CIE 1976 u'v' coordinates.

25. The method of claim 24, wherein the threshold distance is 0.005.

26. A system for manufacturing a lighting panel comprising:

a detector configured to detect a chromaticity of light emitted by a lighting panel;

an adjustor configured to adjust a resistance of an adjustable resistor on the lighting panel;

a controller coupled to the detector and the adjustor and configured to calculate, responsive to the detected chromaticity of light, a difference in drive current through a plurality of first light emitting devices in the lighting panel compared to a drive current through a plurality of second light emitting devices in the lighting panel that would cause light generated by the plurality of first light emitting devices and the plurality of second light emitting devices, when combined, to generate light having a chromaticity point at least within a threshold distance from a desired chromaticity point, and to control the adjustor to adjust the resistance of the laser-trimmable resistor to provide the calculated difference in drive current when the plurality of first light emitting devices and the plurality of second light emitting devices are energized with a drive current.

27. The system of claim 26, wherein the adjustor comprises a laser.

28. The system of claim 26, wherein the adjustor comprises an electronic circuit configured to adjust a resistance of an electronically adjustable resistor.

29. A system for manufacturing a lighting panel including a plurality of light emitting devices connected in serial and including an adjustment circuit connected in parallel to the plurality of light emitting devices, comprising:

a detector configured to detect a chromaticity of light emitted by the plurality of light emitting devices; and a controller coupled to the detector and configured to adjust the resistance of the adjustment circuit in response to the detected chromaticity.

30. A system for manufacturing a lighting panel including a plurality of light emitting devices, comprising:

a detector configured to detect a chromaticity of light emitted by a plurality of first light emitting devices and a plurality of second light emitting devices;

a controller coupled to the detector and configured to calculate, responsive to the detected chromaticity of light, a difference in drive current through the plurality of first light emitting devices compared to a drive current through the plurality of second light emitting devices that would cause light generated by the plurality of first light emitting devices and the plurality of second light emitting devices, when combined, to generate light having a chromaticity point at least within a threshold distance from a desired chromaticity point; and a trimmer coupled to the controller and configured to adjust the resistance of an adjustable resistor in response to the calculated difference in drive current.

31. The system of claim 30, further comprising:

an assembler configured to receive the plurality of first light emitting devices, the plurality of second light emitting devices and the trimmable resistor and to mount the plurality of first light emitting devices, the plurality of second light emitting devices and the trimmable resistor on a panel.

* * * * *

UNITED STATES PATENT AND TRADEMARK OFFICE

CERTIFICATE OF CORRECTION

PATENT NO. : 7,658,527 B2
APPLICATION NO. : 11/353583
DATED : February 9, 2010
INVENTOR(S) : Gwatkin, III It is certified that error appears in the above-identified patent and that said Letters Patent is hereby corrected as shown below:

Column 12, Claim 16, Line 61: Please correct "the first circuit:"
to read -- the first circuit; --

Column 13, Claim 19, Line 39: Please correct "trimrnable"
to read -- trimmable --

Signed and Sealed this

Thirtieth Day of March, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,658,527 B2
APPLICATION NO. : 11/353583
DATED : February 9, 2010
INVENTOR(S) : James deGoulard Gwatkin, III It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1032 days.

Signed and Sealed this

Thirtieth Day of November, 2010

David J. Kappos

David J. Kappos
*Director of the United States Patent and Trademark Office*